US006615818B1

(12) United States Patent
Jimka et al.

(10) Patent No.: US 6,615,818 B1
(45) Date of Patent: Sep. 9, 2003

(54) PREFABRICATED MODULAR STRUCTURE FOR AN OUTDOOR BARBECUE

(76) Inventors: Griselda Noemí Jimka, Av. Ricardo Balbin 2301 (1650) San Martin, Buenos Aires (AR); Victor Jorge Puvi, Av. Ricardo Balbín 2301 (1650), Buenos Aires (AR)

( * ) Notice: Subject to any disclaimer, the term of this patent is extended or adjusted under 35 U.S.C. 154(b) by 0 days.

(21) Appl. No.: 10/161,338

(22) Filed: Jun. 3, 2002

(51) Int. Cl.[7] ..... F24C 15/08
(52) U.S. Cl. ..... 126/8; 126/25 R; 126/506
(58) Field of Search ..... 126/8, 9, 25 R, 126/41 R, 25, 30, 147, 151, 506, 501

(56) References Cited

U.S. PATENT DOCUMENTS

| | | | | |
|---|---|---|---|---|
| 3,976,048 A | | 8/1976 | Ashman, Jr. | |
| 4,136,666 A | | 1/1979 | Haas | |
| 4,274,939 A | | 6/1981 | Scaran | |
| 4,596,232 A | | 6/1986 | Dowding | |
| 5,284,125 A | * | 2/1994 | Hunziker | 126/8 |
| 5,579,755 A | | 12/1996 | Johnston | |
| 5,730,114 A | | 3/1998 | Fabrikant et al. | |
| 6,070,572 A | | 6/2000 | Casagrande | |
| 6,119,679 A | | 9/2000 | Galvin | |
| 6,125,836 A | | 10/2000 | Felton et al. | |
| 6,189,526 B1 | * | 2/2001 | Bland | 126/8 |
| 6,230,700 B1 | | 5/2001 | Daniels et al. | |

FOREIGN PATENT DOCUMENTS

| | | | | |
|---|---|---|---|---|
| DE | 1810895 | * | 6/1970 | 126/25 R |
| WO | WO 01/24674 | * | 4/2001 | 126/8 |

* cited by examiner

*Primary Examiner*—James C. Yeung
(74) *Attorney, Agent, or Firm*—Scully, Scott, Murphy & Presser

(57) ABSTRACT

Fixed outer barbecue modular structure for cooking food, comprising three modulus, a first base modulus which defines a lower larder modulus defined by a base panel, to which two side panels are assembled, a closing back plate and two manhole doors; a second modulus which defines cooking means comprising an inserted base over the former modulus to which two sides are assembled, a bottom plate, a closing rear plate, a barbecue plate and a metallic grate; and finally a third an last modulus comprising an inserted base over the former modulus, wherein a fumes hood and a cowl diffuser are assembled.

10 Claims, 3 Drawing Sheets

PREFABRICATED MODULAR STRUCTURE FOR AN OUTDOOR BARBECUE

FIELD OF INVENTION

The present invention is related to modular manufacturing of products, mainly the manufacture of food cooking arrangements. More particularly, the present invention relates to food cooking arrangements using burning charcoal or mineral coal as a cooking heat source, and more particularly it relates to a prefabricated modular structure for an outdoor barbecue which allows for an easy and cheap method of assembling, without using traditional building methods.

BACKGROUND OF THE INVENTION

Barbecues structures and arrangements for food cooking are well known in the art. Basically, whether fixed or mobile, they always have in common the same elements: a base on which burning coal is supported, a metallic grid structure placed over said base and having height regulating means, where the food to-be cooked is placed and a fume expulsion chute. In order to build up this kind of fixed outdoor barbecue, traditional construction methods are usually used, that is, common brick-and-mortar systems for constructing the structure, refractory bricks on the base, mortar, a metallic grid, height fern adjustment means having a metal bar assembled in a swivel motion on the structure where a pair of chains are attached to the metal grid for raising and lowering it, and a chute that channels and expels fumes. Building this kind of brick-based fireplace structures takes several days, is usually very expensive, and mortar mix is required for binding the different elements thereof. This kind of structure cannot be previously shaped and a qualified worker is required on site.

There is other kind of barbecues, the mobile ones, having an entirely metallic structure including legs with wheels, a base, a grid and regulating means without using a chute. This kind of barbecue is useful to cook foods, but does not have the advantages of a barbecue made of bricks and mortar, which offers a tastier and easier method of cooking.

Prefabricated fixed grates made of structural panels are known in the art such as is disclosed in the U.S. Pat. No. 6,070,572. That patent discloses a fireplace for food cooking having a planar member adapted to have coals dispersed thereon and having two sides extending perpendicular therefrom on opposite sides thereof and a back extending perpendicular therefrom extending between the two sides. A fireplace hood is supported on the two sides and the back. The fireplace hood has a duct extending upwardly therefrom whereby the duct is adapted to allow smoke to discharge from the hood. A baffle plate wall has its ends affixed to the two sides and a back side which is spaced from the back so as to define a hollow space therebetween. The baffle plate wall is positioned between the planar member and the fireplace hood so as to define a combustion chamber and a cooking chamber. The hollow space has an upper opening and a lower opening with the lower opening defining an access inlet adapted to draw the coals in the combustion chamber.

This modular structure defines a modular prefabricated barbecue for the construction of which no traditional building methods are necessary, but does not provide a completely modular structure capable of being shipped in a single container to be easily assembled by the user, as in the present invention. In fact, in accordance with the present invention, the proposed barbecue contains an arranged series of panels which allows the panels to be sold while completely dismantled. They may be sold in pieces inside a single container, and the user may assembly them by joining and fixing the panels together with screws, which turns out to be an easy task.

The inventive aspects as previously mentioned demonstrate the advantages provided by this invention, since it allows for a totally modular product, which when finally assembled results in a traditional fixed outdoor barbecue, without investing in expensive constructions or in having to use heavy modular structures which can not be easily handled by a user, as with the structure disclosed in the above mentioned U.S. Patent '572.

SUMMARY OF THE INVENTION

It is accordingly an object of the present invention to provide a totally modular barbecue, made of structural panels which are separate and designed to be easily assembled by the user, without requiring the latter to be a person skilled in the art. Basically the invention consists of a series of panel including the follows:

A lower housing base referred in this specification as a larder base;

Larder doors;

A larder bottom plate;

A larder left side;

A larder right side;

A larder closing plate;

A metallic bearing bar of the former closing plate;

A barbecue base;

A barbecue bottom plate;

Outer and inner left and right sides;

Barbecue plate;

Closing plate;

Metallic bearing bar of the former closing plate;

Fumes hood base;

Fumes hood; and finally,

Cowl.

All of these collective panels are prefabricated as separated elements allowing for the assembly of the inventive barbecue in a rapid and easy manner, without requiring the services of persons skilled in the construction art. This task may be implemented by the user and for which only a screwdriver will be necessary. These panels can be contained in a single cardboard box in order to furnish its the fast assembly thereof, and eventually its transportation.

Summing up, the outdoor barbecue in accordance with the present invention, includes an independent panels assembly which facilitates an easy and rapid assembly construction thereof, through three basic moduli: a first modulus referred as a "larder" modulus, defining a lower dwelling to store several elements such as cordwood, coal, etc.; a second modulus referred as a "barbecue modulus" and a third and last modulus referred as a "chute" modulus. The first one comprises the assembly of seven different panels which are described in detail herein below, and which comprise: a lower housing base referred to as the larder base; a larder outer door; a larder bottom plate; a larder left side; a larder right side; a larder closing plate, and a metallic binding bar of the former plate. The second modulus defines a surface on which coal or burning cordwood is placed, together with a metallic grid, comprising the following panels: a barbecue base; a barbecue bottom plate; outer and inner left and right sides; a barbecue plate, a closing plate and finally a metallic binding bar of said closing plate. The third and last modulus comprises several panels constituting a chute assembly including the following panels: a fumes exhaust hood base, a fume exhaust hood and cowl.

Basically, the present invention can be defined as a prefabricated modular structure of a fixed or stationary outdoor barbecue for cooking food, comprising three moduli, a first base modulus which defines a lower larder formed by a base panel, to which two side panels are assembled, a closing rear plate and manhole doors; a second modulus which defines a cooking arrangement comprising an insert base over the former modulus to which two sides are assembled, a bottom plate, a closing rear plate, a barbecue plate and a metallic grid; and finally a third and last modulus comprising a base over the former modulus, to which a fumes exhaust hood and a cowl diffuser are assembled.

DETAILED DESCRIPTION OF THE INVENTION

Figure 1:
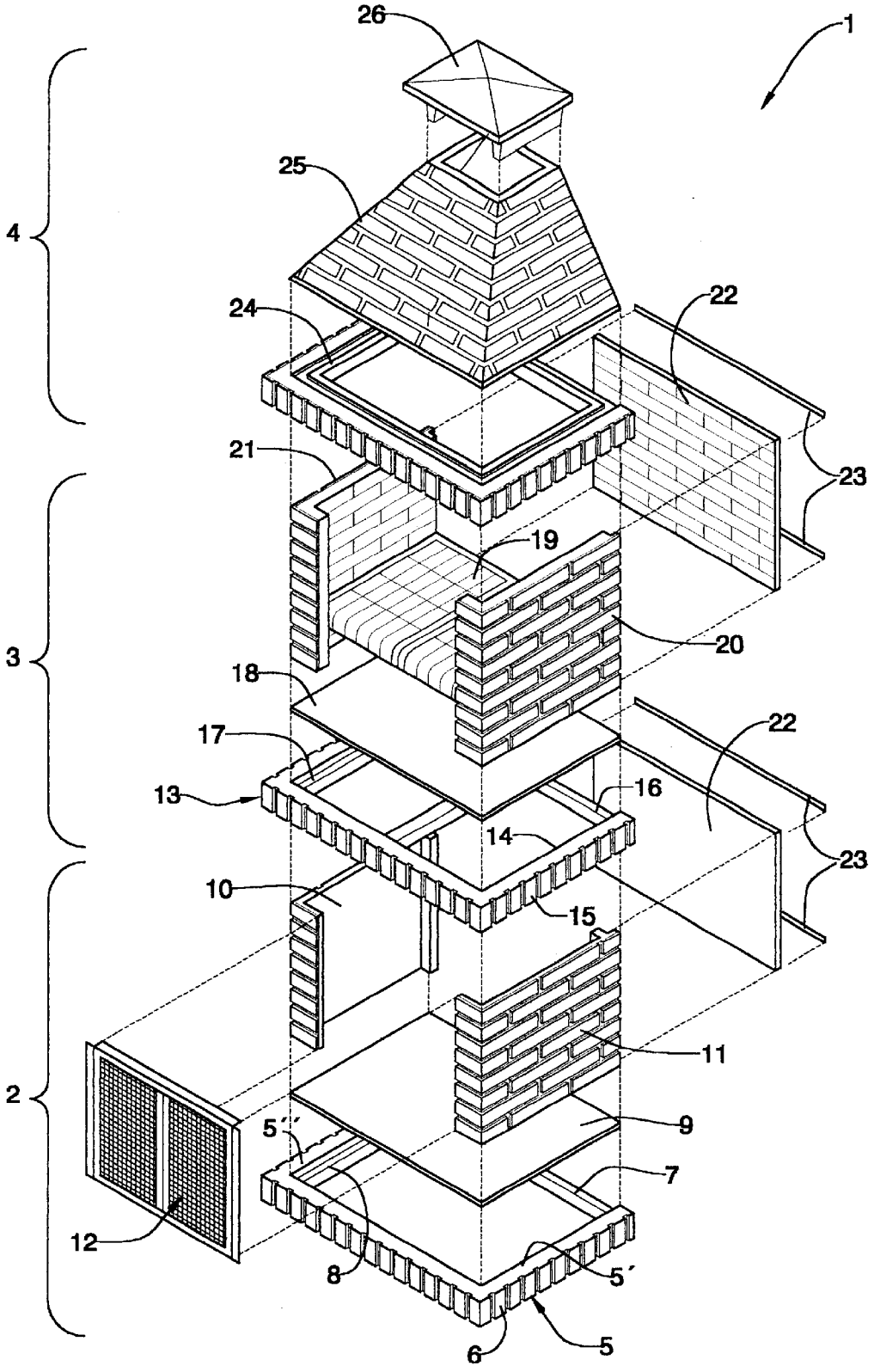
FIG. 1 is a generally perspective and partially exploded view of the barbecue according to the present invention.
Figure 2:
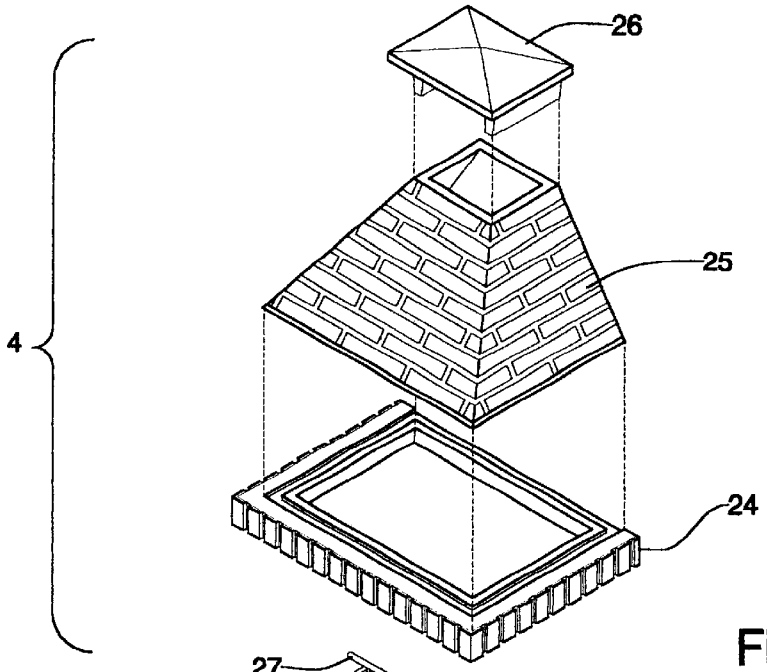
FIG. 2 is another similarly perspective view of the third and last modulus.
Figure 3:
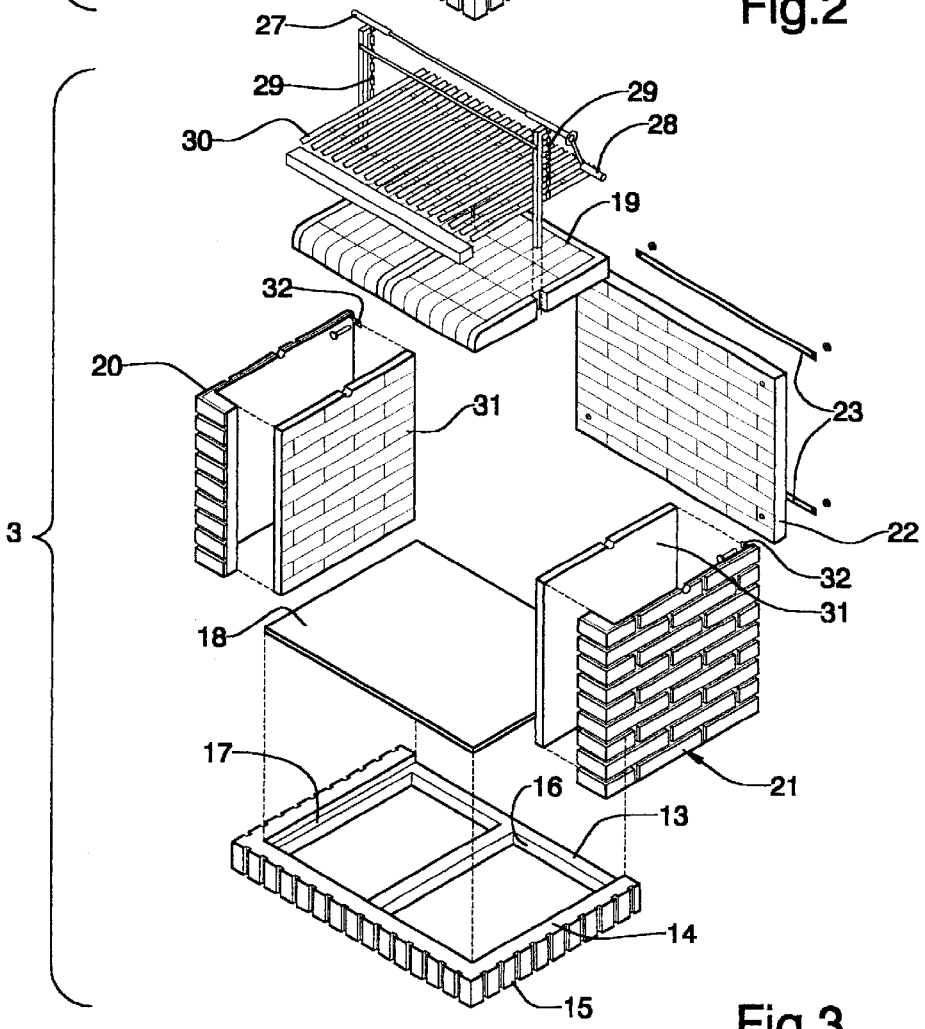
FIG. 3 shows another detail also in a perspective and partially exploded view of the second barbecue modulus.
Figure 4:
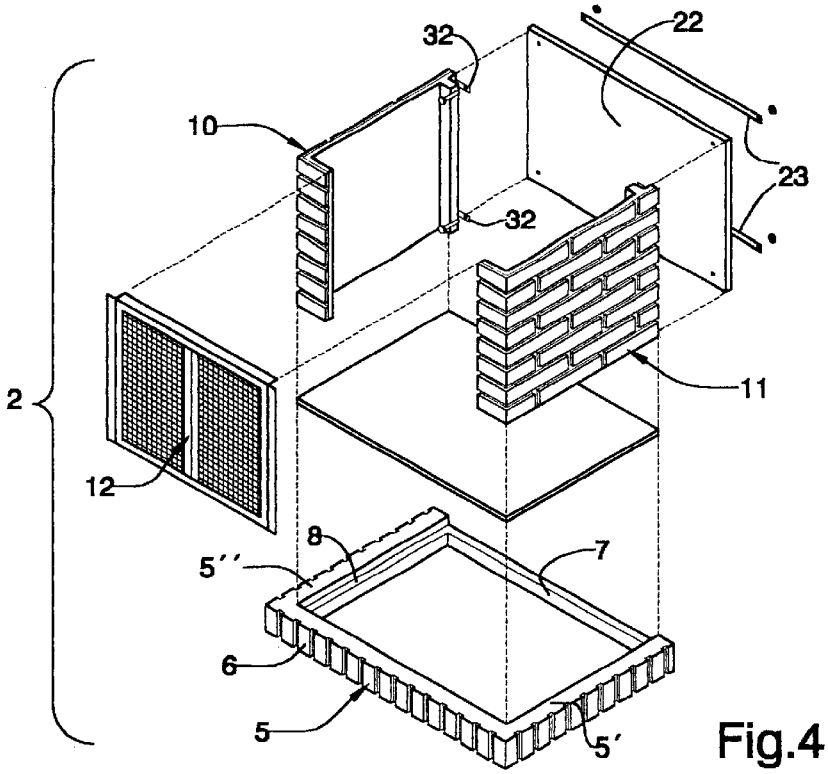
FIG. 4 is another similarly perspective view of the first modulus of the barbecue in accordance to the present invention.
Figure 5:
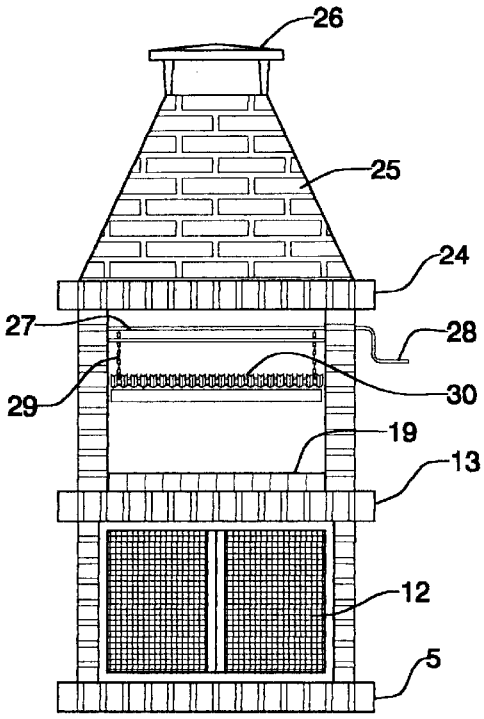
FIG. 5 is a front elevational view.
Figure 6:
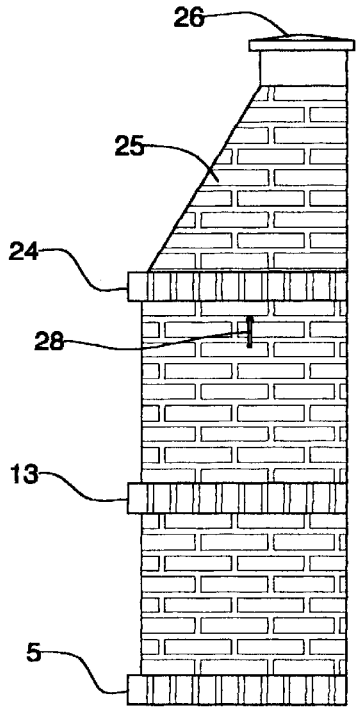
FIG. 6 is a side elevational view.

Referring now to accompanying drawing figures, the proposed barbecue, indicated by the general reference (1), comprises three different moduli, referred as a lower modulus or "larder" modulus (2), an intermediate modulus (3) referred as "barbecue" modulus and a last "chute" modulus (4).

Firstly, there is described the first modulus (2) although it is evident that the above mentioned moduli (2), (3) and (4) make up a unitary product. The modulus (2) defines a larder on the lower side of the barbecue where several elements required to cook food, (such as coal, cordwood, wood, etc.) can be saved by the user. This modulus (2) is comprised of a supporting frame which defines a rectangular base (5) comprising on an outer face a facing brick finish (6), and on its inner face a narrower thickness frame (7) defining a step (8) over which a bottom plate (9) is supported, thereby defining the lardet's floor.

Left and right walls (10) and (11) remain supported over side portions (5'–5") of said base (5), said sides conforming to the side walls of said larder and also having a facing brick finish on its outer face. Modulus (2) is completed with a manhole doors panel (12).

Second modulus (3) comprises a rectangular base (13) having an outer frame (14) with a facing brick finish (15) and an inner frame (16). Between said outer frame (14) and said inner frame (16) a step (17) is defined for supporting a base plate (18) and modulus lateral walls (20–21), similar to the previously mentioned walls (10–11).

Above the plate (18), the barbecue plate (19) is supported so as to provide a burning coals supporting surface on which the food is cooked.

Modulus (3) has also a closing plate (22) which defines the modulus back wall, which is supported and stiffened by two supporting bars (22–23).

Finally, modulus (4) comprises a base (24) which defines a rectangular frame (similar to the previously mentioned frame), wherein a hood (25) is placed completing the modulus with a fume diffuser cowl.

As a result of the above construction, the task of building up the inventive outer barbecue becomes very simple. That is, the first modulus must be initially assembled, for which base (5) must be fitted over a flat surface to which it is fixed.

Over the base (5) there is assembled the larder modulus by first fitting between each other base (9), the sides (10-il), the closing plate (22) and the frontal closing walls (12). This assembly is obtained by using bolts and nuts and is then stiffened by two metal bars (23) which are lodged in corresponding holding sleeves.

Once the first modulus has been assembled, then the second modulus may be assembled thereabove. The base-frame (13) is placed over the walls (10–11) and closing plate (22). The frame will be used as a supporting surface for the bottom plate (18), side walls (20–21) and barbecue plate (19) (on which burning coals are placed whenever a user cooks foods). Side walls (20–21) include two aligned holes whereby the bar (27) is assembled in a swivel motion that includes a handle (28), two chains (29) attached to the bar (27) and to a grid (30) where food is placed to be cooked. The bar (27) defines the height adjustment means of the barbecue grid, and is not described in detail herein since it is a well known aspect of the prior art.

Just as in the previous case, the second modulus is stiffened by two bars (23) which are fitted in respective holding sleeves.

Once the second modulus is assembled, base (24) is placed over side walls (20–21) and plate (22) whereupon hood (25) and finally said cowl (26) are placed in position.

From the foregoing explanation and drawings, it is readily concluded that by means of using an easy and creative series of constructive panels, an inexpensive and easy-to-assemble and transportable prefabricated barbecue is defined provided, without requiring the services of a person skilled in the construction art.

What is claimed is:

1. A stacking outdoor modular barbecue structure for cooking foods, comprising first, second and third structurally interconnected modules (2, 3, 4), said first module (2) comprising a base module of chamber including a base frame (5) with fitting means (5'–8), two assembled lower side walls (10–11) being connected with each other by a rear closing plate (22), fitting means aid rear closing plate to said lower side walls (10–11), said second module (3) forming cooking means comprising a middle frame (13) fitting in a top edge of said two lower side walls (10–11) through one side and through another side said middle frame receiving top side walls (20–21) which fit in a top part of said middle frame (13) and in a bottom plate (18), said walls and frame being stiffened by a second rear closing plate (22) which is jointed to said top side walls (20–21) by fitting means (23), and said third module (4) forming a cone-shaped fume and smoke exhaust hood which comprises a top frame (24) having a lower housing means for the fitting thereto of the top edge of the top side walls (20–21), and top housing means in said top frame (24) for housing the perimetrical edges of said cone-shaped smoke and fume exhausted hood.

2. A modular structure according to claim 1, wherein the fitting means (5'–8) are integrated in the frame (5) and comprise an inner perimetrical groove for retaining the lower edges of the lower side walls (10–11).

3. A modular structure according to claim 1 or 2, wherein the inner perimetrical groove of the frame (4) receives said bottom plate.

4. A modular structure according to claim 1, wherein the fitting means (23) of the rear plate (22) comprise a pair of internal projections formed in the inner edge of the lower sad walls (10–11) and which are formed with through-extending holes coinciding with holes formed I the rear plate, said holes housing fixing pins having metal girders which extend between both said lower side walls (10–11).

5. A modular structure according to claim 1, wherein said middle frame (13) has a first perimetrical inner groove on a bottom edge thereof, the top edge of the lower side walls (10–11) being fitted in said groove, and a second perimetrical inner groove being formed on the top edge of said middle frame in which there is fitted the lower edge of the top side walls (20–21).

6. A modular structure according to claim 5, wherein said second perimetrical inner groove receives a bottom plate (18) on which a grilling plate (19) is supported.

7. A modular structure according to claim 1, wherein the fixing means (23) of the top side walls (20–21) comprise holes having projecting pins on the rear edges of said walls, said pins extending through coinciding holes formed I the second rear closing plate and being fastened to metal girders extending between both top side walls.

8. A modular structure according to claim 1, wherein said top frame (24) comprises a firs perimetrical inner groove on its lower edge, the top edge of the top side walls (20–21) being fitted in said groove, and a second perimetrical inner groove formed on the top edge of said frame wherein the lower edge of the cone-shaped smoke and fume exhaust hood is fitted.

9. A structure according to claim 1, wherein the side walls (20–21) are each comprised of a decorated outer plate, a refractive inner plate and supporting means for a transportable barbecue with a grilling plate (19).

10. A structure according to claim 1, wherein a structure having access doors is mounted between the lower side walls and opposite to said rear plate (22).

* * * * *